US007909564B2

(12) United States Patent
Kizuka et al.

(10) Patent No.: US 7,909,564 B2
(45) Date of Patent: Mar. 22, 2011

(54) GAS TURBINE AND GAS TURBINE COOLING METHOD

(75) Inventors: Nobuaki Kizuka, Hitachinaka (JP); Shinya Marushima, Hitachinaka (JP); Masami Noda, Hitachinaka (JP); Shinichi Higuchi, Hitachinaka (JP); Yasuhiro Horiuchi, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 43 days.

(21) Appl. No.: 12/405,802

(22) Filed: Mar. 17, 2009

(65) Prior Publication Data

US 2009/0196738 A1 Aug. 6, 2009

Related U.S. Application Data

(63) Continuation of application No. 11/174,555, filed on Jul. 6, 2005, now Pat. No. 7,507,069.

(30) Foreign Application Priority Data

Jul. 7, 2004 (JP) ..... 2004-200005

(51) Int. Cl.
*F04D 29/44* (2006.01)

(52) U.S. Cl. ..... 415/1; 415/209.2; 415/209.3

(58) Field of Classification Search ..... 415/1, 191, 415/199.5, 209.2, 209.3
See application file for complete search history.

(56) References Cited

U.S. PATENT DOCUMENTS

| | | | | |
|---|---|---|---|---|
| 4,113,406 | A | 9/1978 | Lee et al. | |
| 4,666,368 | A * | 5/1987 | Hook et al. | 415/115 |
| 4,820,116 | A | 4/1989 | Hovan et al. | |
| 5,215,435 | A * | 6/1993 | Webb et al. | 277/414 |
| 5,253,976 | A * | 10/1993 | Cunha | 415/114 |
| 5,749,584 | A | 5/1998 | Skinner et al. | |
| 5,749,701 | A | 5/1998 | Clarke et al. | |
| 6,045,134 | A | 4/2000 | Turnquist et al. | |
| 6,164,908 | A | 12/2000 | Nishida et al. | |
| 6,558,114 | B1 | 5/2003 | Tapley et al. | |
| 6,854,736 | B2 | 2/2005 | Parpotna | |
| 2001/0007384 | A1 | 7/2001 | Skinner et al. | |

FOREIGN PATENT DOCUMENTS

| | | |
|---|---|---|
| EP | 0383046 | 8/1990 |
| JP | 62-37204 | 8/1987 |

* cited by examiner

*Primary Examiner* — Edward Look
*Assistant Examiner* — Aaron R Eastman
(74) *Attorney, Agent, or Firm* — Brundidge & Stanger, P.C.

(57) ABSTRACT

A gas turbine includes a nozzle vane and a sealing unit engaged with the nozzle vane inside a turbine supplied with combustion gases produced by mixing and burning air for combustion and fuel. The nozzle vane and the sealing unit are disposed in a channel of the downward flowing combustion gases on the outlet side of a gas path. A plurality of engagement portions between the sealing unit and the nozzle vane are provided successively from the upstream side toward the downstream side in a direction of flow of the combustion gases, and a downstream one of the plurality of engagement portions has a contact interface formed in a direction across a turbine rotary shaft. A reduction in the thermal efficiency of the gas turbine can be suppressed.

8 Claims, 6 Drawing Sheets

GAS TURBINE AND GAS TURBINE COOLING METHOD

This application is a continuation application of U.S. application Ser. No. 11/174,555, filed Jul. 6, 2005, now U.S. Pat. No. 7,507,069, the entirety of which is incorporated herein by reference.

BACKGROUND OF THE INVENTION

1. Field of the Invention

The present invention relates to a gas turbine and a gas turbine cooling method.

2. Description of the Related Art

In a gas turbine, air is compressed by a compressor and fuel is added to the compressed air to produce an air-fuel mixture. The air-fuel mixture is burnt and resulting high-temperature, high-pressure combustion gases are used to drive the turbine. Thermal efficiency of an overall gas turbine plant can be increased by combining it with another plant, such as a steam turbine. Meanwhile, in a recent gas turbine, a pressure ratio of the combustion gases has been increased with intent to increase the thermal efficiency by using the gas turbine alone. For that reason, the differential pressure across each turbine blade provided in a gas path in a turbine section has been increased in comparison with that in the past. This gives rise to the necessity of reducing the amount of sealing air leaked through gaps between adjacent parts. In order to prevent the combustion gases from flowing into the inside of a turbine rotor, for example, the sealing air supplied to a wheel space on the upstream side must be prevented from leaking to a wheel space on the downstream side through a gap between the turbine rotor as a rotating member and a nozzle vane as a stationary member. To that end, a diaphragm is engaged with a lower portion of the nozzle vane.

For the purpose of holding air tightness of a cavity defined by the nozzle vane and the diaphragm, JP-B-62-37204 discloses a structure in which prestress is applied to a foot end of the diaphragm (i.e., a diaphragm hook) such that the diaphragm hook comes into pressure contact with a nozzle vane hook.

SUMMARY OF THE INVENTION

However, when prestress is applied to the diaphragm hook as disclosed in JP-B-62-37204, this may cause a deterioration of materials. More specifically, temperatures of gas turbine components change from the normal room temperature to a level of 400-500° C. depending on an operating state, and such a large temperature change raises a possibility that the diaphragm hook may be subjected to an excessive load. From the viewpoint of avoiding the possibility, it is desired that no prestress be applied to the diaphragm hook. On the other hand, if the contact between the diaphragm hook and the nozzle vane hook is insufficient, there arise a possibility that most of the sealing air in the cavity may leak to the wheel space on the downstream side where the pressure is relatively low.

An object of the present invention is to suppress a reduction in the thermal efficiency of a gas turbine attributable to a leak of the sealing air, which is supplied to the wheel space on the upstream side, from there toward the wheel space on the downstream side.

To achieve the above object, according to the present invention, a plurality of engagement portions between a sealing unit and a nozzle vane are provided successively from the upstream side toward the downstream side in a direction of flow of combustion gases, and downstream one of the plurality of engagement portions has a contact interface formed in a direction across a turbine rotary shaft.

With the present invention, a reduction in the thermal efficiency of the gas turbine can be suppressed which is attributable to a leak of the sealing air supplied to a wheel space on the upstream side from there toward a wheel space on the downstream side.

DESCRIPTION OF THE PREFERRED EMBODIMENTS

Figure 1:
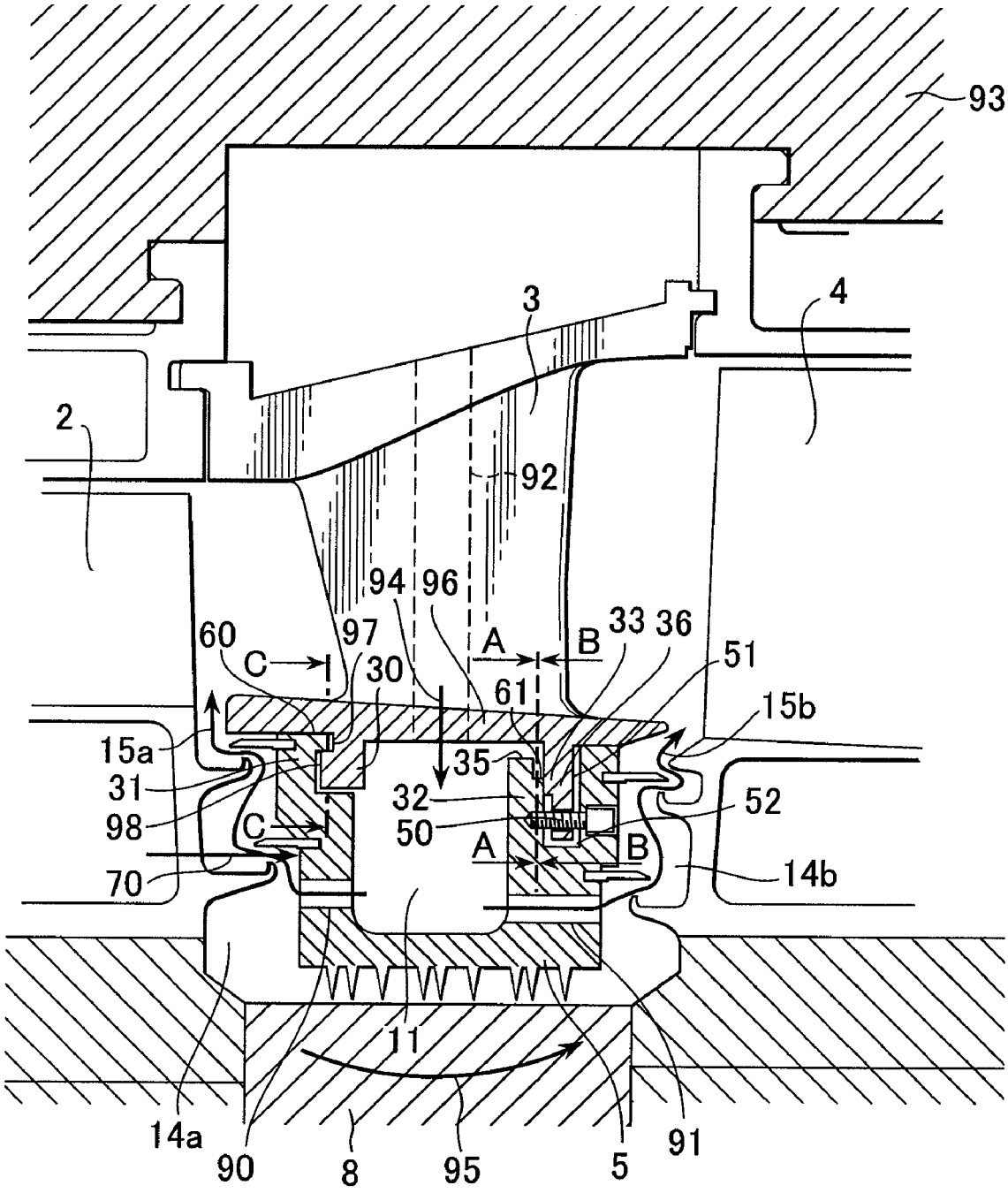
FIG. 1 is a sectional view of a nozzle vane and a diaphragm.

Thermal efficiency of an overall gas turbine plant can be increased by combining it with another plant, such as a steam turbine. In a recent gas turbine, however, a pressure ratio of combustion gases has been increased with intent to increase the thermal efficiency by using the gas turbine alone. In that gas turbine, the differential pressure across each turbine blade in a gas path, i.e., in a gas channel inside the turbine, has been increased in comparison with that in the past. Accordingly, if gaps between adjacent parts remain the same as in the past, the amount of the sealing air flowing through the gaps between adjacent parts is increased to reduce the thermal efficiency of the gas turbine, whereby the advantage resulting from increasing the pressure ratio of the combustion gases is lessened. In other words, to increase the thermal efficiency of the gas turbine having a larger pressure ratio of the combustion gases, it is desired to eliminate or minimize the wasteful leak of the sealing air through the gaps between adjacent parts.

In general, a nozzle vane in each of second and subsequent stages of the turbine includes a diaphragm disposed between the nozzle vane and a rotor disk as a rotating member on the inner peripheral side. Then, a sealing structure is disposed in a gap between the diaphragm as a stationary member and the rotor disk as the rotating member, to thereby prevent the combustion gases from bypassing through the gap. In this connection, the sealing air is supplied from the nozzle vane side to a cavity inside the diaphragm serving as a sealing means. The sealing air is discharged from the cavity inside the diaphragm to wheel spaces on the upstream and downstream sides. In embodiments described below, it is assumed that the side into which the combustion gases flow from a combustor is the upstream side, and the side from which the combustion gases are discharged after flowing through the turbine (i.e., the gas path outlet side) is the downstream side. If positive sealing is not provided in engagement portions between the diaphragm and the nozzle vane, the sealing air inside the diaphragm leaks to the wheel space on the downstream side through the engagement portion on the downstream side. One reason is that because the pressure of a wheel space atmosphere is higher on the upstream side, the supply pressure of the sealing air must be set higher than the pressure of the wheel space atmosphere on the upstream side. Another reason is that because the differential pressure caused between the wheel spaces on the upstream and downstream sides is large, most of the sealing air leaks to the wheel space on the downstream side unless any sealing means is provided in the downstream-side engagement portion between the nozzle vane and the diaphragm. Such a leak of the sealing air is problematic in that the flow rate of the sealing air supplied to the upstream side becomes insufficient and the amount of the sealing air must be increased correspondingly in the whole of the gas turbine, thus resulting in a reduction in the thermal efficiency of the gas turbine. For the reasons mentioned above, positive sealing is required in the engagement portions between the nozzle vane and the diaphragm.

First Embodiment

Figure 2:
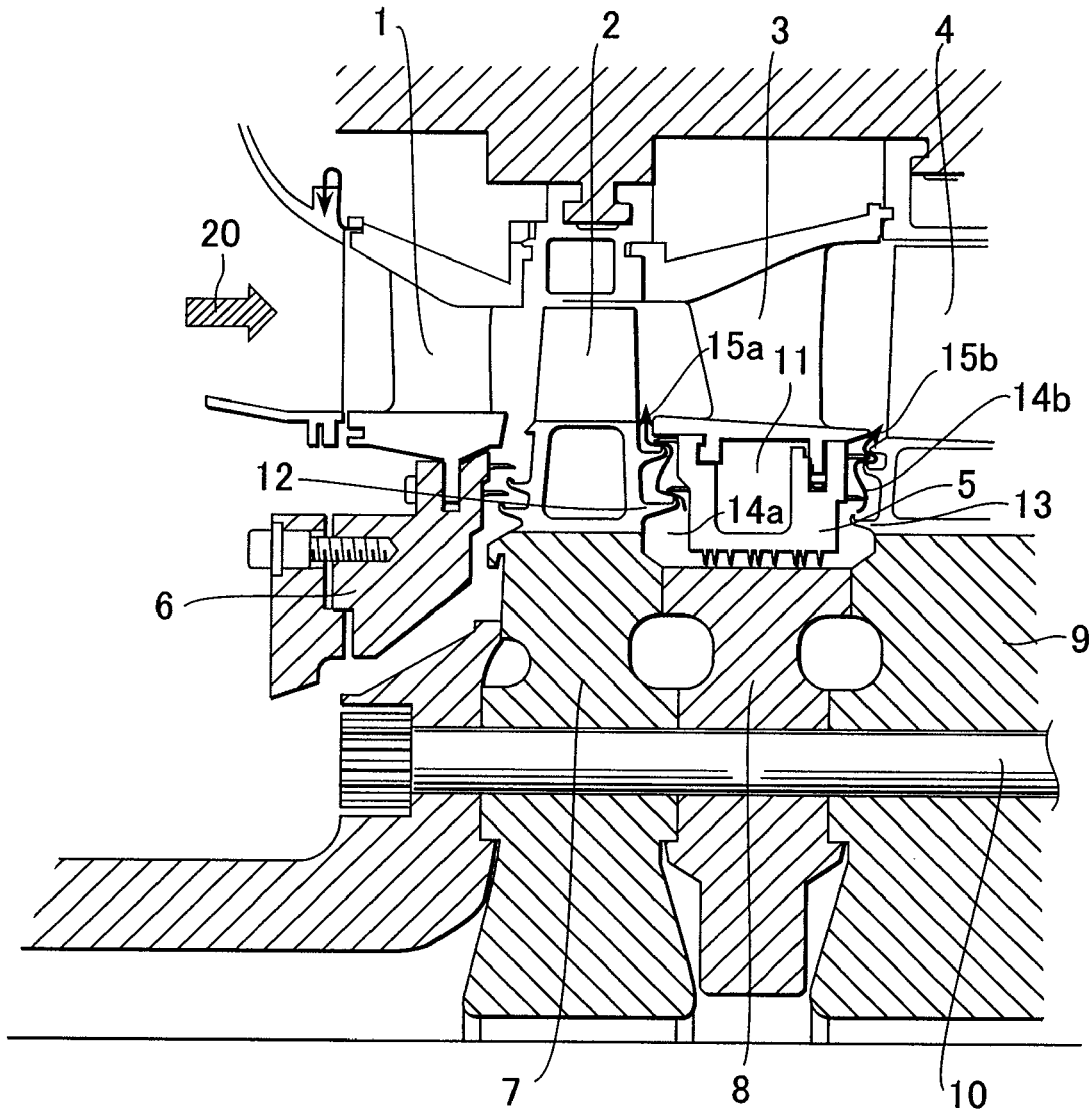
FIG. 2 is a sectional view of a principal part of a gas turbine according to one embodiment, which is equipped with the nozzle vane and the diaphragm.

The structure of the gas turbine will be described with reference to FIG. 2. FIG. 2 shows a section of a principal part (blade stage section) of the gas turbine according to a first embodiment. An arrow 20 in FIG. 2 indicates the direction of flow of combustion gases. Numeral 1 denotes a first stage nozzle vane, 3 denotes a second stage nozzle vane, 2 denotes a first stage rotor blade, and 4 denotes a second stage rotor blade. Also, numeral 5 denotes a diaphragm, 6 denotes a distance piece, 7 denotes a first stage rotor disk, 8 denotes a disk spacer, and 9 denotes a second stage rotor disk.

The first stage rotor blade 2 is fixed to the rotor disk 7, and the second stage rotor blade 4 is fixed to the rotor disk 9. The distance piece 6, the rotor disk 7, the disk spacer 8, and the rotor disk 9 are integrally fixed by a stub shaft 10 to form a turbine rotor as a rotating member. The turbine rotor is fixed coaxially with not only a rotary shaft of a compressor, but also a rotary shaft of a load, e.g., a generator.

The gas turbine comprises a compressor for compressing atmospheric air to produce compressed air, a combustor for mixing the compressed air produced by the compressor with fuel and burning an air-fuel mixture, and a turbine rotated by combustion gases exiting the combustor. Further, the nozzle vanes and the rotor blades are disposed in a channel for the combustion gases flowing downstream inside the turbine. High-temperature and high-pressure combustion gases 20 exiting the combustor are converted to a flow with swirling energy by the first stage nozzle vane 1 and the second stage nozzle vane 3, thereby rotating the first stage rotor disk 2 and the second stage rotor disk 4. A generator is rotated with rotational energy of both the rotor disks to produce electricity. A part of the rotational energy is used to drive the compressor. Because the combustion gas temperature in the gas turbine is generally not lower than the allowable temperature of the blade (vane) material, the blades (vanes) subjected to the high-temperature combustion gases must be cooled.

The cooling structure of the second stage rotor disk 3 will be described below. FIG. 1 is a sectional view of the second stage nozzle vane 3 and the diaphragm 5 in an axial direction. A cavity 11 is defined by the second stage nozzle vane 3 and the diaphragm 5, and air for sealing off wheel spaces 14*a*, 14*b* is supplied to the cavity 11 through a coolant channel provided in the second stage nozzle vane 3. In this embodiment, air is used as a coolant. The wheel space 14*a* is a gap which is formed by the diaphragm 5 and a shank portion 12 connecting the first stage rotor blade 2 and the rotor disk 7, and which is positioned upstream of the diaphragm 5. The wheel space 14*b* is a gap which is formed by the diaphragm 5 and a shank portion 13 connecting the second stage rotor blade 4 and the rotor disk 9, and which is positioned downstream of the diaphragm 5. The cavity 11 and the wheel space 14*a* are communicated with each other through a hole 90 formed in the diaphragm 5. Similarly, the cavity 11 and the wheel space 14*b* are communicated with each other through a hole 91 formed in the diaphragm 5. Further, the second stage nozzle vane 3 is fixed to an outer casing 93 constituting the turbine, and the diaphragm 5 is engaged with the second stage nozzle vane 3 at plural points. On the other hand, the disk spacer 8 rotates as a rotating member. Then, the diaphragm 5 and the disk spacer 8 provide a sealing structure between them. With that sealing structure, the wheel spaces 14*a* and 14*b* are prevented from spatially communicating with each other and can be formed as independent spaces. Additionally, a coolant 94 is supplied to the cavity 11 through a coolant channel 92 formed in the second stage nozzle vane 3, followed by flowing into the wheel space 14*a* upstream of the diaphragm 5 and the wheel space 14*b* downstream of the diaphragm 5 through the holes 90, 91, respectively. The coolant 94 is released as sealing air 15*a*, 15*b* into the gas path to prevent the combustion gases 20 from flowing into the interior side from an inner peripheral wall surface of the gas path.

When the sealing structure provided by the diaphragm 5 and the disk spacer 8 is formed as a honeycomb seal, the sealing ability is very high. It is therefore desired that the coolant 94 introduced to the cavity 11 be supplied to both the wheel space 14*a* upstream of the diaphragm 5 and the wheel space 14*b* downstream of the diaphragm 5. On the other hand, when the sealing structure provided by the diaphragm 5 and the disk spacer 8 is formed as a labyrinth seal, the sealing ability is somewhat smaller than that of the honeycomb seal. Taking into account a flow of the coolant 94 directing from the wheel space 14*a* toward the wheel space 14*b* via the labyrinth seal, therefore, the coolant 94 introduced to the cavity 11 may be supplied to only the wheel space 14*a* upstream of the diaphragm 5. By supplying the coolant 94 from the cavity 11 to only the wheel space 14*a* upstream of the diaphragm 5, the hole 91 formed in the diaphragm 5 can be dispensed with, thus resulting in an improvement in manufacturability of the diaphragm 5.

If the high-temperature combustion gases 20 flow into the wheel spaces 14*a*, 14*b* and the atmosphere temperatures in the wheel spaces rise correspondingly, the shank portions 12, 13 or the diaphragm 5 is thermally damaged by the combustion gases 20. Further, excessive thermal loads are imposed on the rotor disks 7, 9 and the disk spacer 8. This raises a possibility that thermal stresses increased with the excessive thermal loads may shorten life spans of individual members, and abnormal thermal deformations of the members may cause a trouble in turbine rotation, thus resulting in a difficulty in continuing normal operation of the gas turbine. In order to continue the normal operation of the gas turbine, therefore, it is desired that the sealing air be positively supplied to the wheel spaces 14*a*, 14*b*.

Comparing the atmosphere pressures in the second stage nozzle vane 3, the pressure in the wheel space 14*a* on the upstream side is higher than the pressure in the wheel space 14*b* on the downstream side. Although such a pressure difference changes depending on various conditions, it is usually about twice. Accordingly, when the sealing air is supplied to the wheel space 14*a*, the pressure in the cavity 11 is preferably set higher than the pressure in the wheel space 14*a*. A plurality of engagement portions between the second stage nozzle vane 3 and the diaphragm 5 are provided successively from the upstream side toward the downstream side in the direction of flow of the combustion gases, and the cavity 11 is defined by an inner surface of the diaphragm 5 and a lower surface of the second stage nozzle vane 3. In this embodiment, the engagement portions between the second stage nozzle vane 3 and the diaphragm 5 are provided two, i.e., one on each of the upstream side and the downstream side. If air tightness of the cavity 11 is not held, the sealing air leaks to the downstream side where the pressure is relatively low, and the sealing air cannot be supplied to the upstream side in sufficient amount. In the gas turbine having a larger pressure ratio of the combustion gases, there is a tendency that the differential pressure between the upstream side and the downstream side of the nozzle vane increases. For that reason, if air tightness of the cavity 11 is not ensured, the amount of the sealing air leaking through the engagement portion on the downstream side is increased. If the amount of the sealing air supplied to the cavity 11 is increased to ensure a sufficient amount of the sealing air on the upstream side without reducing the amount of the sealing air leaking through the engagement portion on the downstream side, the amount of the sealing air leaking to the downstream side is increased in proportion to the increased amount of the sealing air supplied. To ensure a sufficient amount of the sealing air on the upstream side in such a manner, the sealing air must be supplied in a larger amount. Such an increase in the amount of the sealing air supplied lessens the effect of increasing the thermal efficiency of the gas turbine having a larger pressure ratio of the combustion gases.

With intent to avoid the above-mentioned drawback, this embodiment includes a plurality of engagement portions between respective hooks of the second stage nozzle vane 3 and the diaphragm 5 both constituting the cavity 11. In this embodiment, those engagement portions are provided two, i.e., one on each of the upstream side and the downstream side. In the upstream one of the two engagement portions, a sealing interface 60 is formed by a nozzle vane hook 30 and a diaphragm hook 31 in the circumferential direction of a circle about a turbine rotary shaft. Then, the nozzle vane hook 30 and the diaphragm hook 31 are mated with each other at the sealing interface 60. At this time, to ensure positive contact for sealing-off on the downstream side, the nozzle vane hook 30 and the diaphragm hook 31 forming the engagement portion on the upstream side are arranged such that gaps 97 and 98 are left as clearances in the axial direction to hold the two hooks from not contacting with each other in the axial direction.

In the engagement portion on the downstream side, a nozzle vane hook 33 is inserted in a diaphragm hook 32 formed substantially in a U-shape. A set pin 50 is inserted to extend through the diaphragm hook 32 and the nozzle vane hook 33 to hold them in a fixed positional relationship, whereby motions of the diaphragm 5 are restrained. Additionally, a proper gap 52 is left between the set pin 50 and an inner periphery of a pin bore 51 formed in the nozzle vane hook 33. In other words, the pin bore 51 formed in the nozzle vane hook 33 has a larger diameter than the set pin 50. Usually, the position and dimension of the set pin 50 are decided in consideration of design errors so that the positional relationship between the nozzle vane hook 33 and the diaphragm hook 32 is accurately held fixed even during the operation of the gas turbine. However, if no gap 52 is left between the set pin 50 and the inner periphery of the pin bore 51 formed in the nozzle vane hook 33, the set pin 50 is not adaptable to thermal deformations of the nozzle vane hook 33 and the diaphragm hook 32, and excessive thermal stresses are generated around the pin bore 51. The thermal deformations of the nozzle vane hook 33 and the diaphragm hook 32 can be absorbed by setting the diameter of the pin bore 51 formed in the nozzle vane hook 33 larger than that of the set pin 50 and leaving the gap 52 in such a size as being able to accommodate those thermal deformations. Further, a sealing interface 61, i.e., a contact interface, between the nozzle vane hook 33 and the diaphragm hook 32 is formed in a direction across the turbine rotary shaft. A recessed step portion 35 is formed in a part of the diaphragm hook 32 at a position nearer to the outer peripheral side than the sealing interface, and a recessed step portion 36 is formed in a part of the nozzle vane hook 33 at a position nearer to the inner peripheral side than the sealing interface. Each of those recessed step portions has a level difference defined by both the contact surface and a plane shifted from the contact surface in the axial direction of the turbine rotary shaft.

Figure 3:
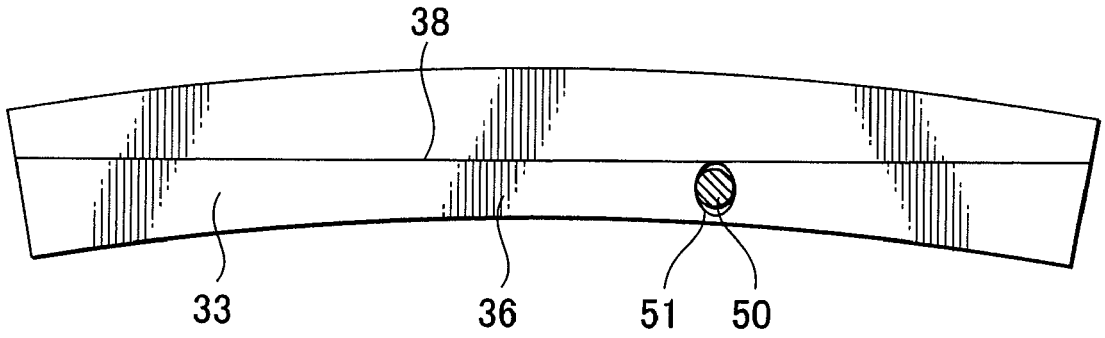
FIG. 3 is a sectional view taken along the line A-A in FIG. 1.
Figure 4:
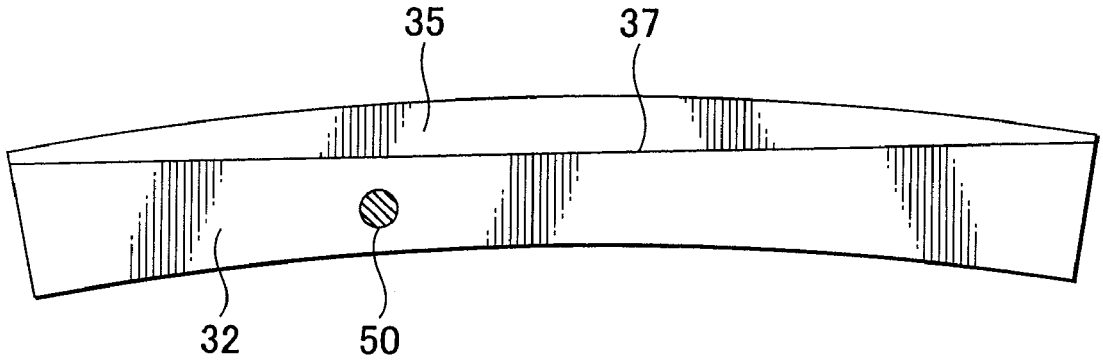
FIG. 4 is a sectional view taken along the line B-B in FIG. 1.

FIG. 3 shows a cross-section of the nozzle vane hook 33 taken along the line A-A in FIG. 1. FIG. 4 shows a cross-section of the diaphragm hook 32 taken along the line B-B in FIG. 1. As shown in FIG. 3, a boundary 38 of the recessed step portion 36 is formed to extend substantially linearly. As shown in FIG. 4, a boundary 37 of the recessed step portion 35 is also formed to extend substantially linearly. Since the recessed step portions 35, 36 of the diaphragm hook 32 and the nozzle vane hook 33 have the substantially linear boundaries 37, 38, those members can be machined more easily than the case of the boundaries being curved. Note that there is no problem even if the boundaries 37, 38 are not exactly linear due to machining errors.

Figure 5:
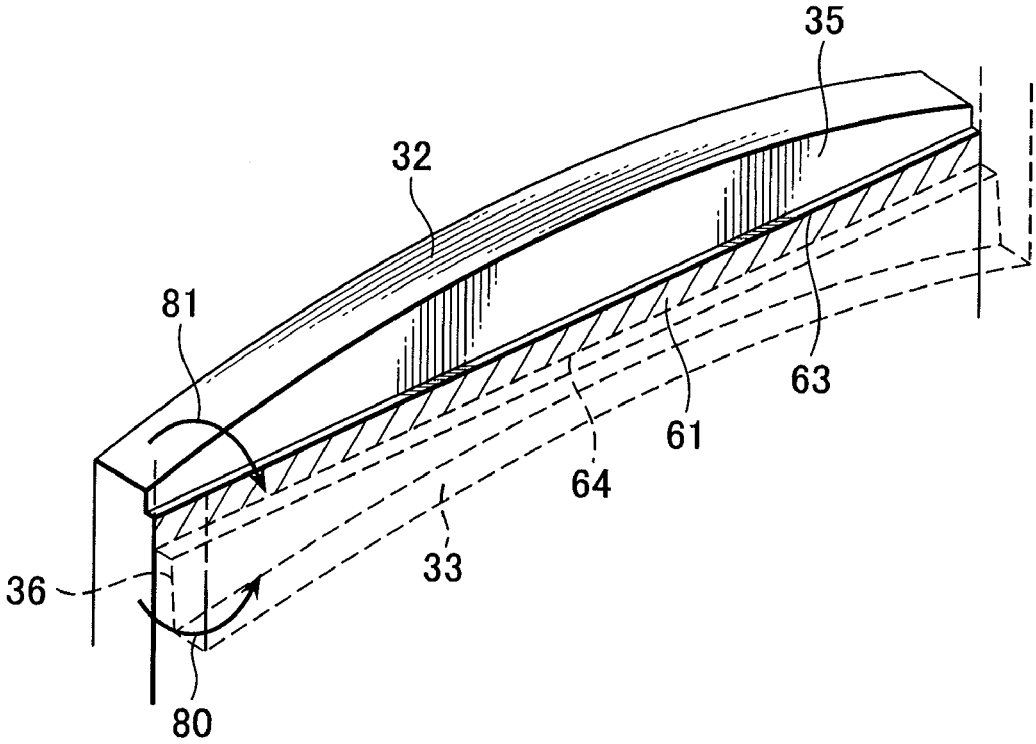
FIG. 5 is a perspective view showing engagement between a nozzle vane hook and a diaphragm hook in FIG. 1.

FIG. 5 shows the downstream-side engagement portion between the diaphragm hook 32 and the nozzle vane hook 33 which are formed as described above. The provision of the recessed step portions 35, 36 allows the sealing interface 61 to have any suitable width in practice. If the width of the sealing interface 61 is too narrow, the sealing interface is not adaptable for a shift of the mating between the diaphragm and the nozzle vane. Conversely, if it is too wide, the surface pressure is reduced. For those reasons, the width of the sealing interface 61 is preferably in the range of 3-7 mm. Note that, in FIG. 5, the sealing interface 61 having a band-like shape is indicated by a hatched area.

Figure 8:
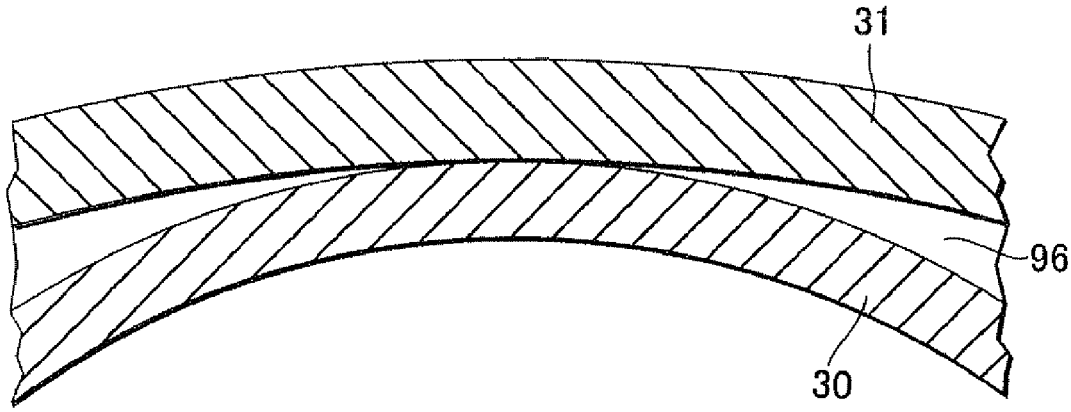
FIG. 8 is a sectional view taken along the line C-C in FIG. 1.
Figure 10:
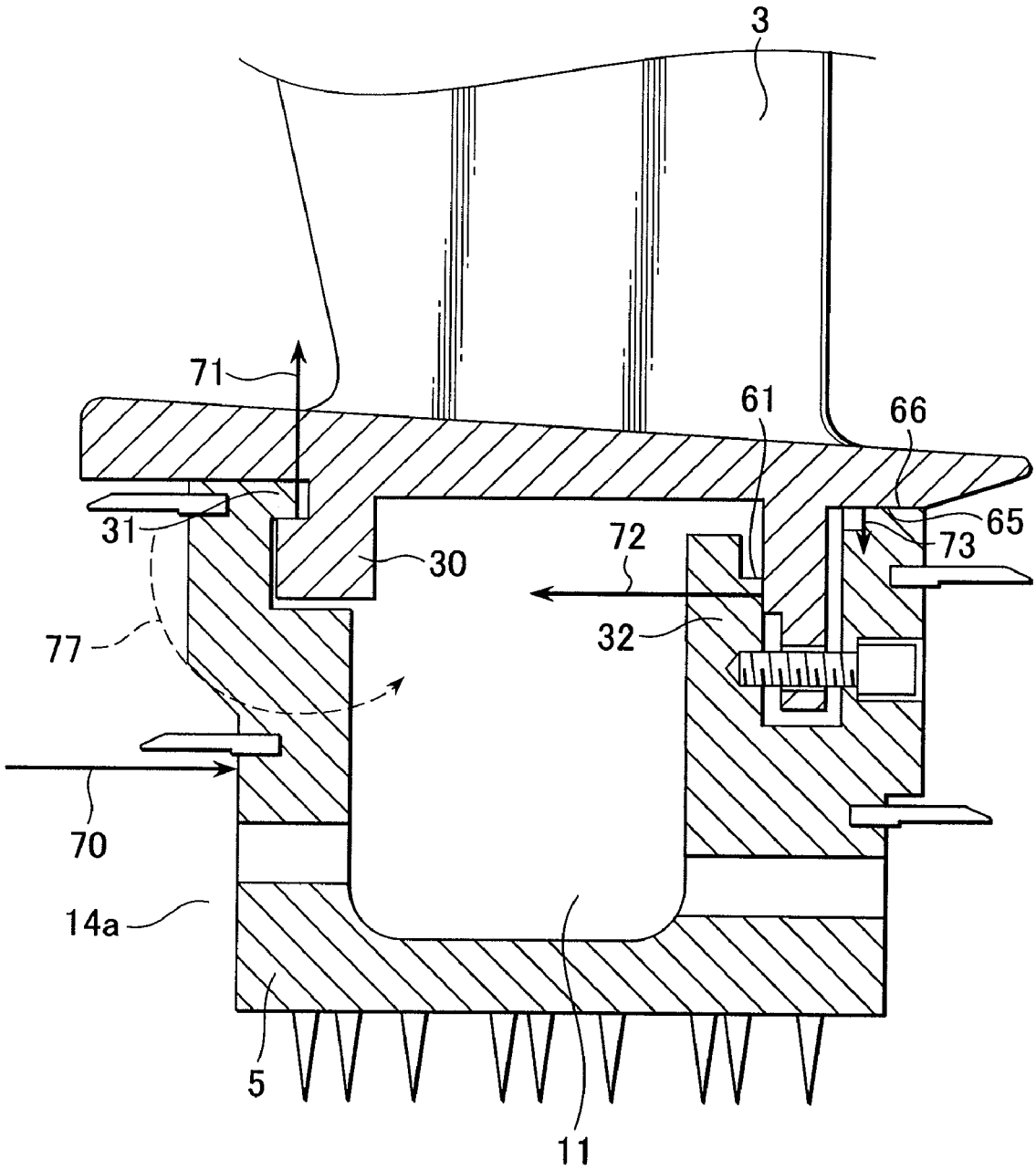
FIG. 10 is an enlarged view of the diaphragm hook.

A description is made of the action of the engagement portion between the diaphragm hook 32 and the nozzle vane hook 33 in this embodiment during the operation of the gas turbine. Referring to FIG. 10, due to the differential pressure between the upstream side and the downstream side, an action force 70 acts on the diaphragm 5 toward the downstream side. As a force opposing the action force 70, a reaction force 72 is generated to act on the sealing interface 61. Because the action force 70 and the reaction force 72 are not in a coaxial relation, there occurs a moment 77 acting on the diaphragm 5. At this time, the diaphragm 5 is going to rotate in the direction of the moment 77 with the upstream-side engagement portion serving as a fulcrum. However, since a downstream-side end 65 of the diaphragm hook 32 contacts with an inner-peripheral end wall 66 of the second stage nozzle vane 3 and is restrained from moving unintentionally, a diaphragm sealing surface and a nozzle vane sealing surface are held in parallel relation. Then, action forces 71, 73 are generated to act on the diaphragm hook 31 and the downstream-side end 65 of the diaphragm hook 32, respectively. In the upstream-side engagement portion, therefore, the nozzle vane hook 30 and the diaphragm hook 31 are further fastened together by the action force 71. Accordingly, the surface pressure at the upstream-side sealing surfaces is increased and the sealing effect is enhanced. The upstream-side sealing surfaces are contacted with each other in the circumferential direction of a circle about the turbine rotary shaft. FIG. 8 shows the sealing surfaces as a sectional view taken along the line C-C in FIG. 1. As shown in FIG. 8, the thermal deformations of the nozzle vane hook 30 and the diaphragm hook 31 change the radii of curvatures of their sealing surfaces contacting with each other, thereby generating a small gap 96 between both the hooks. However, the differential pressure across the upstream-side engagement portion, i.e., the differential pressure between the cavity 11 and the wheel space 14*a*, is relatively small, and the surface pressure at the upstream-side sealing surfaces is increased by the action force 71. As a result, the leak amount of the sealing air can be reduced to a negligible level.

The upstream-side engagement portion is of a structure in which the diaphragm hook 31 is latched by the nozzle vane hook 30. Thus, because the diaphragm hook 31 and the nozzle vane hook 30 are in a relatively movable state, a leak of the sealing air through both the upstream-side engagement portion and the downstream-side engagement portion can be reduced by effectively utilizing the above-mentioned moment 77. As a result, a reduction in the thermal efficiency of the gas turbine can be suppressed which is attributable to the leak of the sealing air supplied to the wheel space on the upstream side from there toward the wheel space on the downstream side.

On the other hand, in the downstream-side engagement portion, the diaphragm hook 32 receives the reaction force 72 from the nozzle vane hook 33 such that both the hooks are pressed against each other, and a large force of the magnitude almost equal to that of the action force 70 acts on the sealing interface 61. At this time, since the sealing interface 61, i.e., the contact interface formed in the downstream-side engagement portion, is formed to extend in the direction across the turbine rotary shaft, a large force of the magnitude almost equal to that of the action force 70 acts on the entire sealing interface 61. Preferably, the sealing interface 61 is substantially perpendicular to the turbine rotary shaft. Also, since the sealing interface 61 as the contact interface is a flat plane, a plane deviation is small even when both the hooks are thermally deformed. Further, since the surface pressure is increased with the sealing interface 61 having a band-like shape, no gap is generated at the sealing interface 61 and positive sealing can be realized even when subjected to a large differential pressure. Stated another way, since the upstream-side sealing interface of the downstream-side engagement portion does not provide contact in the circumferential direction of a circle about the turbine rotary shaft, but forms the contact interface extending in the direction across the turbine rotary shaft, it is possible to provide a reliable sealing structure between the nozzle vane and the diaphragm, which causes no performance reduction due to the leak of the sealing air.

The related art disclosed in JP-B-62-37204 employs a structure in which prestress is applied to the diaphragm hook, and accompanies with a possibility of causing a deterioration of diaphragm materials. Also, because the gas turbine is operated under a wide variety of temperature conditions, there is a possibility of affecting durability of the diaphragm in all the operating states of the gas turbine. In contrast, this embodiment has the structure in which the diaphragm hook 31 is latched by the nozzle vane hook 30 and no prestress is applied to the diaphragm hook 31. Accordingly, durability of the diaphragm can be maintained in all the operating states of the gas turbine.

As shown in FIGS. 3 to 5, the sealing surface boundaries 37, 38 defined by the recessed step portions 35, 36 are formed substantially linearly. Therefore, even when the parallelism between the sealing surface of the diaphragm hook and the sealing surface of the nozzle vane hook in the downstream-side engagement portion is deviated in a small range due to, e.g., thermal deformations of those hooks during the gas turbine operation, such a deviation can be accommodated. For example, when the nozzle vane hook 33 is rotated relative to the diaphragm hook 32 in the direction of an arrow 80, a sealing edge of a linear-contact sealing portion 63 is maintained tight so as to suppress the generation of a gap. Also, when the nozzle vane hook 33 is rotated relative to the diaphragm hook 32 in the direction of an arrow 81, a sealing edge of a linear-contact sealing portion 64 is maintained tight so as to suppress the generation of a gap. With such a sealing manner, even in the case of operating the gas turbine having a larger pressure ratio of the combustion gases, it is possible to reduce the amount of the sealing air unintentionally leaked from the cavity 11 through the downstream-side engagement portion. Then, the sealing air can be positively supplied from the cavity 11 to both the wheel spaces 14*a* and 14*b*. Further, the amount of the sealing air used in total can be reduced to the least necessary amount, and therefore a reduction in the thermal efficiency of the gas turbine can be suppressed. Note that, since the provision of at least one of the recessed step portions 35, 36 is enough to form the contact interface extending in the direction across the turbine rotary shaft, similar advantages to the above-mentioned ones can also be obtained with only one of the recessed step portions 35, 36.

In this embodiment, unlike the related art, any additional member, e.g., a packing, is not provided on each of the diaphragm hook and the nozzle vane hook. The members of the downstream-side engagement portion, i.e., a set of the nozzle vane hook and its contact portion contacting with the diaphragm hook and a set of the diaphragm hook and its contact portion contacting with the nozzle vane hook, are each formed as an integral part. This structure contributes to avoiding damage of the members and improving reliability in operation. Furthermore, this embodiment can be realized with a simpler structure and easier machining because of using no complicated means, such as a spring and packing.

Figure 9:
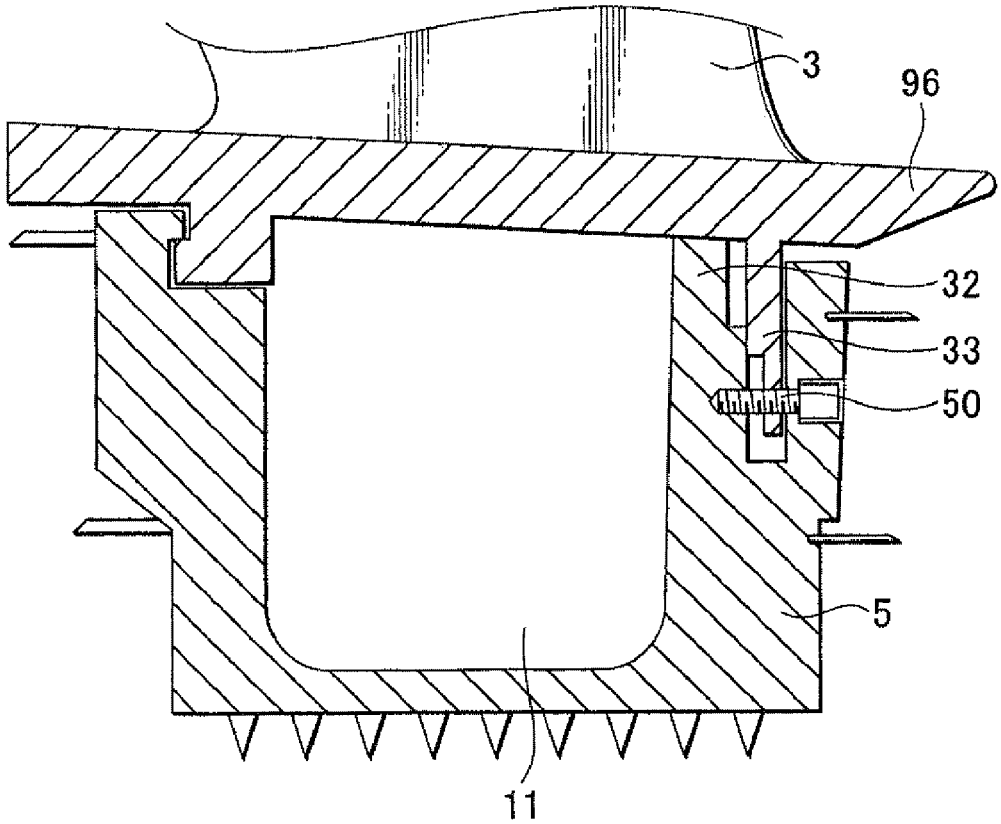
FIG. 9 is a sectional view showing a modification of the diaphragm hook.

Moreover, as shown in FIG. 1, an upper surface of the diaphragm hook 32 formed substantially in a U-shape and a lower surface of an intermediate portion 96, to which the nozzle vane hook 33 is fixed, are held in surface contact with each other in the circumferential direction of a circle about the turbine rotary shaft. With that surface contact, even when a moment acts on the diaphragm 5, it is possible to restrict a displacement of the diaphragm 5 relative to the second stage nozzle vane 3. If the displacement of the diaphragm 5 relative to the second stage nozzle vane 3 can be restricted, the engagement at the most-downstream end between the diaphragm hook 32 and the nozzle vane hook 33 (i.e., the intermediate portion 96) is not essential in this embodiment. In other words, the construction of this embodiment may be modified, by way of example, as shown in FIG. 9 without problems. In any case, the displacement of the diaphragm 5 can be restricted by contacting the diaphragm 5 and the second stage nozzle vane 3 with each other at a position closer to the downstream-side engagement portion to such an extent that the displacement of the diaphragm 5 relative to the second stage nozzle vane 3 can be restricted. Such contact minimizes the displacement of the diaphragm 5 relative to the second stage nozzle vane 3. That contact is also effective in facilitating mutual positioning of the nozzle vane hook 33 and the diaphragm hook 32 when they are assembled together in a turbine assembly process.

Further, since the second stage nozzle vane 3 and the diaphragm 5 are engaged with each other in the upstream-side engagement portion and the upper surface of the diaphragm hook 32 and the lower surface of the intermediate portion 96, to which the nozzle vane hook 33 is fixed, are held in surface contact with each other in the downstream-side engagement portion, a maximum displacement of the diaphragm 5 relative to the second stage nozzle vane 3 is restricted. Therefore, the nozzle vane hook 33 and the diaphragm hook 32 in the downstream-side engagement portion can be avoided from excessively displacing from each other. The contact surface formed in the downstream-side engagement portion to extend in the direction across the turbine rotary shaft is adaptable for a slight displacement between the second stage nozzle vane 3 and the diaphragm 5, but it accompanies with a possibility that the effect of the contact surface may not be developed when the displacement increases. With this embodiment, however, since the diaphragm and the nozzle vane are mutually supported at two points, i.e., two engagement portions between them on the upstream side and the downstream side, a maximum displacement of the diaphragm relative to the nozzle vane can be restricted. Additionally, when the diaphragm is supported on the nozzle vane at two points through two engagement portions between them on the upstream side and the downstream side, more positive sealing can be realized by forming the downstream-side engagement portion such that the contact surface extends in the direction across the turbine rotary shaft. Preferably, the contact surface is substantially perpendicular to the turbine rotary shaft.

While the advantages of this first embodiment have been described in connection with the second stage nozzle vane and the diaphragm, the structure of this first embodiment is not limited to the second stage and is applicable to the nozzle vane and the diaphragm in each stage of the gas turbine including many stages of nozzle vanes and diaphragms.

Second Embodiment

Figure 6:
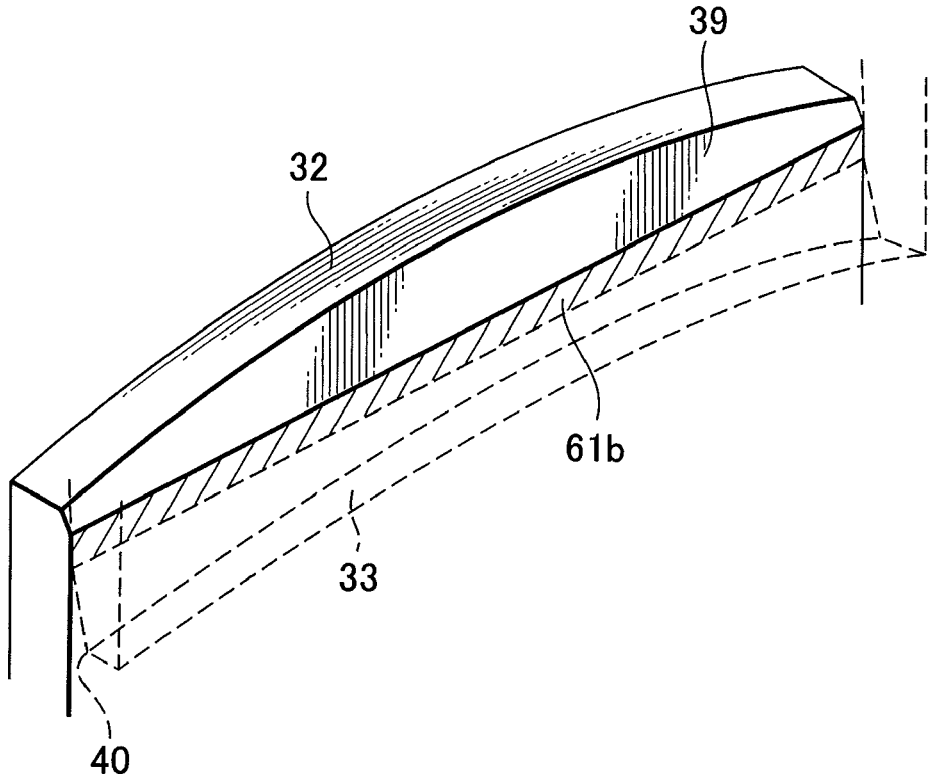
FIG. 6 is a perspective view showing a modification of the engagement between the nozzle vane hook and the diaphragm hook.

FIG. 6 shows a second embodiment of the present invention. According to this embodiment, in the downstream-side engagement portion between the second stage nozzle vane 3 and the diaphragm 5, a slope 39 is formed in the diaphragm hook 32 on the side closer to the outer periphery from the sealing interface. Further, a slope 40 is formed in the nozzle vane hook 33 on the side closer to the inner periphery from the sealing interface. More specifically, each slope 39, 40 is formed as a hook wall surface inclined at any desired angle from the direction perpendicular to the turbine rotary shaft. Even with such a structure, a sealing interface 61*b* (indicated by a hatched area in FIG. 6) is formed substantially in a band-like shape, and therefore the amount of the sealing air unintentionally leaking through the downstream-side engagement portion can be reduced. Further, similar advantages can also be obtained with such a modification that a recessed step portion is formed in one of the diaphragm hook and the nozzle vane hook and a slope is formed in the other hook. The shape of each slope is not limited to particular one, and similar advantages can also be obtained with a linear or curved slope so long as the sealing interface is formed substantially in a band-like shape.

Figure 7:
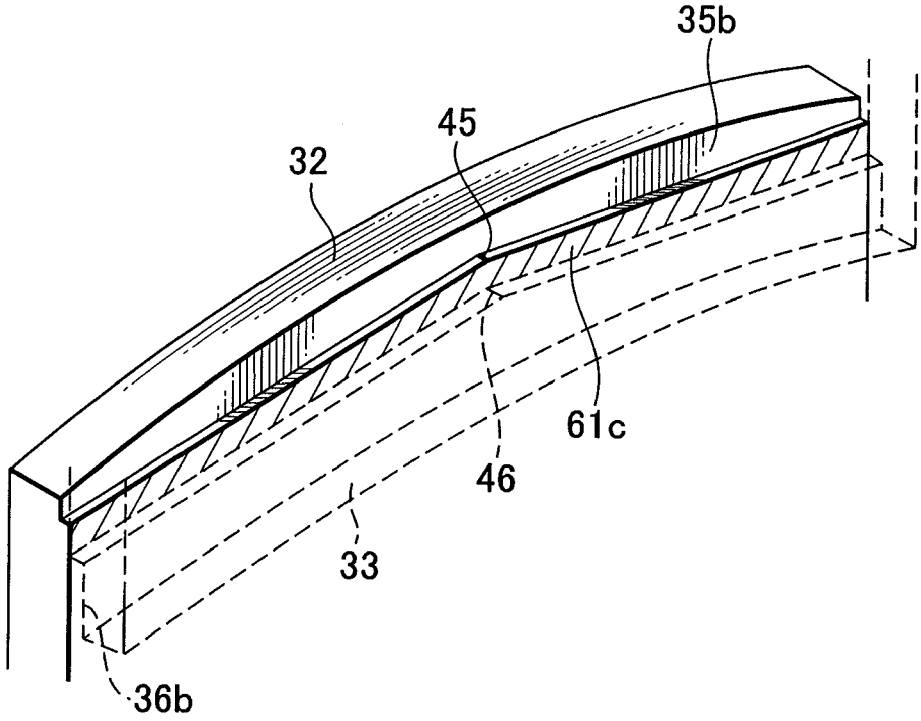
FIG. 7 is a perspective view showing another modification of the engagement between the nozzle vane hook and the diaphragm hook.

FIG. 7 shows another example in which the boundaries of the recessed step portions of the diaphragm and the nozzle vane are each formed as an angularly bent line. It is desired that the boundaries of the band-shaped sealing surfaces of the diaphragm and the nozzle vane be as linear as possible. However, when a difficulty arises in forming the boundaries to be linear because of a structure using coupled vanes, the recessed step portions may be modified, as indicated by 35*b*, 36*b*, such that their boundaries have angularly bent points 45, 46 and an angularly bent sealing interface 61*c* is formed (as indicated by a hatched area in FIG. 7). A sufficient sealing effect is obtained when the parallelism between the sealing surfaces of both the hooks is substantially held, as with the above-described engagement structure of the nozzle vane and the diaphragm. Although the sealing effect is somewhat reduced, a practically advantageous effect is obtained even when the boundary of the sealing interface is formed as a gently curved line or a linear line having a plurality of angularly bent points.

Thus, by employing any of the structures for supporting the nozzle vane hook and the diaphragm according to the embodiments described above, the amount of the sealing air unintentionally leaking from the cavity defined by the nozzle vane and the diaphragm can be reduced in the gas turbine having a large pressure ratio of the combustion gases. Further, a high reliable gas turbine can be provided by positively supplying the sealing air to the upstream side while avoiding a possibility that an increase in the thermal efficiency of the gas turbine, which is resulted from setting a larger pressure ratio of the combustion gases, may be reduced with a leak of the sealing air through the diaphragm.

What is claimed is:

1. A gas turbine comprising a compressor for producing compressed air, a combustor for mixing and burning the compressed air and fuel, and a turbine rotated by combustion gases exiting said combustor, said turbine including a gas path formed therein between a casing and a turbine rotor for passage of the combustion gases, a nozzle vane and a diaphragm engaging with said nozzle vane which are disposed in a channel of the downward flowing combustion gases on the outlet side of said gas path, an upstream-side wheel space and a downstream-side wheel space formed between said diaphragm and corresponding rotor blades, and holes formed in upstream- and downstream-side lateral walls of said diaphragm for communication with said upstream-side wheel space and said downstream-side wheel space to supply a coolant in said diaphragm to said upstream-side wheel space and said downstream-side wheel space, wherein said turbine further includes a plurality of engagement portions between said diaphragm and said nozzle vane, which are provided successively from the upstream side toward the downstream side in a direction of flow of the combustion gases, a first nozzle vane hook and a first diaphragm hook arranged to provide a relatively upstream first one of said plurality of engagement portions with a first contact interface thereof formed in a circumferential direction of a circle about a turbine rotary shaft, and a second nozzle vane hook and a second diaphragm hook arranged to provide a relatively downstream second one of said plurality of engagement portions with a second contact interface thereof formed in a direction across the turbine rotary shaft, wherein the downstream-side engagement portion has a first surface of said nozzle vane that is radially inward-facing with respect to said turbine rotary shaft, and a second surface of said second diaphragm hook that is radially outward-facing with respect to said turbine rotary shaft, held in contact with each other, and wherein a slope having a wall surface inclined at any desired angle from a direction perpendicular to said turbine rotary shaft is formed in at least one of said second nozzle vane hook and said second diaphragm hook, and said slope is formed in at least one of said second nozzle vane hook and said second diaphragm hook at said second contact interface of said second engagement portion.

2. The gas turbine according to claim 1, wherein the second diaphragm hook is formed substantially in a U-shape and said second nozzle vane hook is inserted into said U-shape, and wherein the gas turbine further comprises a set pin inserted through a pin bore to extend through said second diaphragm hook and said second nozzle vane hook inserted in said U-shape, with a gap formed between said set pin and an inner periphery of said pin bore formed in said second nozzle vane hook.

3. The gas turbine according to claim 1, wherein the gas turbine further comprises a set pin inserted through a pin bore to extend through said second diaphragm hook and said second nozzle vane hook, and wherein the set pin is radially inward of the second contact interface.

4. The gas turbine according to claim 3, wherein the second diaphragm hook is formed substantially in a U-shape and said second nozzle vane hook is inserted into said U-shape, and wherein the set pin is inserted through said pin bore to extend through said second diaphragm hook and said second nozzle vane hook inserted in said U-shape, with a gap formed between said set pin and an inner periphery of said pin bore formed in said second nozzle vane hook.

5. A method of cooling a gas turbine comprising a compressor for producing compressed air, a combustor for mixing and burning the compressed air and fuel, and a turbine rotated by combustion gases exiting said combustor, said turbine including a gas path formed therein between a casing and a turbine rotor for passage of the combustion gases, a nozzle vane and a diaphragm engaging with said nozzle vane which are disposed in a channel of the downward flowing combustion gases on the outlet side of said gas path, an upstream-side wheel space and a downstream-side wheel space formed between said diaphragm and corresponding rotor blades, and holes formed in upstream- and downstream-side lateral walls of said diaphragm for communication with said upstream-side wheel space and said downstream-side wheel space, the method comprising the steps of:

providing a plurality of engagement portions between said diaphragm and said nozzle vane, which are provided successively from the upstream side toward the downstream side in a direction of flow of the combustion gases, providing a first nozzle vane hook and a first diaphragm hook such that a relatively upstream first one of said plurality of engagement portions has a contact interface thereof formed in a circumferential direction of a circle about a turbine rotary shaft, and providing a second nozzle vane hook and a second diaphragm hook such that a relatively downstream second one of said plurality of engagement portions has a second contact interface thereof formed in a direction across the turbine rotary shaft, wherein the downstream-side engagement portion has a first surface of said nozzle vane that is radially inward-facing with respect to said turbine rotary shaft, and a second surface of said second diaphragm hook that is radially outward-facing with respect to said turbine rotary shaft, held in contact with each other, and wherein a slope having a wall surface inclined at any desired angle from a direction perpendicular to said turbine rotary shaft is formed in at least one of said second nozzle vane hook and said second diaphragm hook, and said slope is formed in at least one of said second nozzle vane hook and said second diaphragm hook at said second contact interface of said second engagement portion.

6. The method of cooling a gas turbine according to claim 5, wherein the second diaphragm hook is formed substantially in a U-shape and said second nozzle vane hook is inserted into said U-shape, and wherein the gas turbine further comprises a set pin inserted through a pin bore to extend through said second diaphragm hook and said second nozzle vane hook inserted in said U-shape, with a gap formed between said set pin and an inner periphery of said pin bore formed in said second nozzle vane hook.

7. The method of cooling a gas turbine according to claim 5, wherein the gas turbine further comprises a set pin inserted through a pin bore to extend through said second diaphragm hook and said second nozzle vane hook, and wherein the set pin is radially inward of the second contact interface.

8. The method of cooling a gas turbine according to claim 7, wherein the second diaphragm hook is formed substantially in a U-shape and said second nozzle vane hook is inserted into said U-shape, and wherein the set pin is inserted through said pin bore to extend through said second diaphragm hook and said second nozzle vane hook inserted in said U-shape, with a gap formed between said set pin and an inner periphery of said pin bore formed in said second nozzle vane hook.

* * * * *